United States Patent [19]

Pfleger

[11] 4,399,568

[45] Aug. 23, 1983

[54] BELT AND METHOD OF MANUFACTURE

[76] Inventor: Frederick W. Pfleger, 27 Cherry Ave., Maple Shade, N.J. 08052

[21] Appl. No.: 156,809

[22] Filed: Jun. 5, 1980

[51] Int. Cl.[3] ..... A41F 9/00

[52] U.S. Cl. ..... 2/322; 2/338; 24/36; 24/169; 24/186

[58] Field of Search ..... 2/322, 321, 338, 336; 24/36, 169, 176, 186, 198, 35, 188, 172, 189, 199, 190, 187

[56] References Cited

U.S. PATENT DOCUMENTS

| | | | |
|---|---|---|---|
| 217,044 | 7/1879 | Barrow | 24/36 |
| 1,678,264 | 7/1928 | Moore et al. | 24/169 |
| 1,887,614 | 11/1932 | Alterson | 2/322 X |
| 1,934,951 | 11/1933 | Schaefer | 24/186 |
| 2,419,662 | 4/1947 | Sutton | 24/186 |
| 3,175,233 | 3/1965 | Caravella | 2/322 X |
| 3,571,862 | 3/1971 | Zemek | 24/36 |

FOREIGN PATENT DOCUMENTS

| | | | |
|---|---|---|---|
| 907435 | 6/1945 | France | 24/186 |
| 2382206 | 11/1978 | France | 2/322 |

*Primary Examiner*—H. Hampton Hunter
*Attorney, Agent, or Firm*—Robert K. Youtie

[57] ABSTRACT

A belt and method of manufacture wherein belting strips and buckles are fed in timed relation to an assembly station, the buckles including arms which are clinched about respective belt strips at the assembly station.

3 Claims, 4 Drawing Figures

BELT AND METHOD OF MANUFACTURE

BACKGROUND OF THE INVENTION

While the belt construction and method of manufacture of the instant invention have been primarily developed and employed for use with pet collars, and particularly for use with flea and tick collars for dogs and domestic pets, it is appreciated that the instant invention is capable of many varied applications, all of which are intended to be comprehended herein.

As is well known to those versed in the art of animal husbandry, flea and tick collars for dogs and other pets are produced in very large quantities, so that even small savings per unit or collar become quite substantial in the overall picture. Heretofore it was common practice to collect large quantities of belt strips and buckles, and individually rivet each buckle to a belt strip, to produce a belt of the type shown in U.S. Pat. No. 3,918,407. While a simple assembly operation, it was essentially manual and cost reduction involved increased dexterity and skill of operators.

In addition to the above mentioned patent, applicant is aware of the below listed prior art:

| U.S. Pat. No. | Patentee |
|---|---|
| 54,928 | LOEWENBERG |
| 460,066 | BELL |
| 742,993 | IZANT |
| 1,476,852 | TABLER |
| 1,934,951 | SCHAEFER |
| 2,419,662 | SUTTON |
| 3,570,077 | HAWIE |
| 3,571,862 | ZEMEK |
| 4,148,424 | FORTENBERRY |

SUMMARY OF THE INVENTION

It is an important object of the present invention to provide an improved belt construction and method of assembly which permits of substantially complete automation to effect substantial savings in labor costs, and further which effects substantial savings in costs of materials.

It is another object of the present invention to provide a unique method adapted for automatic feeding of components to an assembly station, and automatic assembly at the station to effectively eliminate manual assembly operations, to effect substantial savings in cost and reliability in production.

It is still another object of the present invention to provide a belt construction having the advantageous characteristics mentioned in the preceding paragraphs, which is extremely simple, requiring a minimum number of parts, for enhanced durability and reliability throughout a long useful life.

Other objects of the present invention will become apparent upon reading the following specification and referring to the accompanying drawings, which form a material part of this disclosure.

The invention according consists in the features of construction, combinations and arrangements of parts and method steps, which will be exemplified in the following description, and of which the scope will be indicated by the appended claims.

DESCRIPTION OF THE PREFERRED EMBODIMENT

Figure 1:
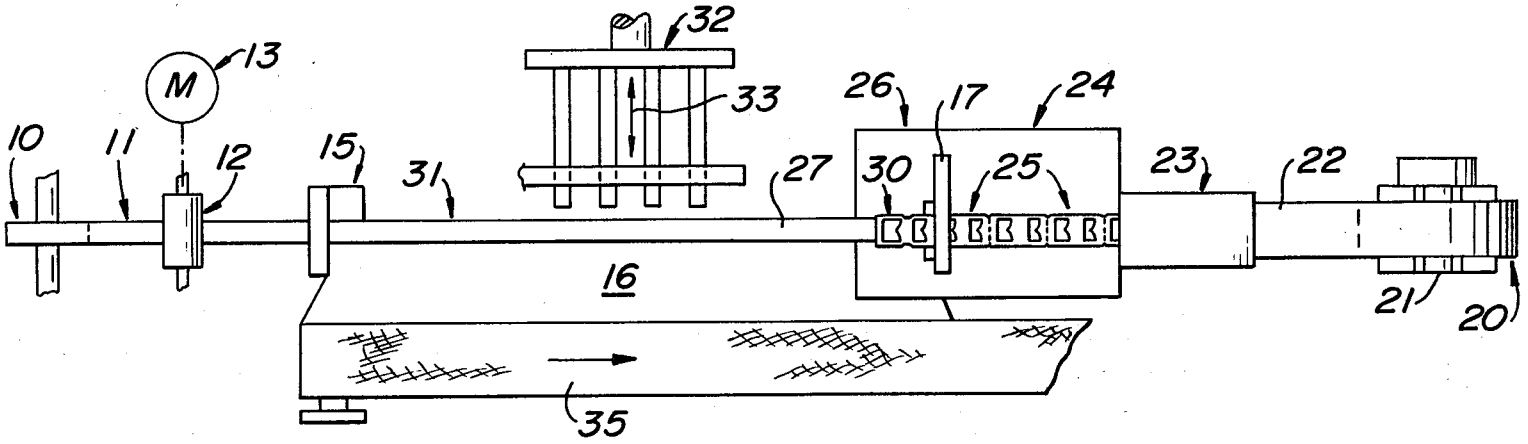
FIG. 1 is a diagrammatic plan view illustrating the method of the present invention.

Referring now more particularly to the drawings, and specifically to FIG. 1 thereof, a belt supply is generally designated 10, and may supply a substantially continuous, elongate belting material 11, as from a coil, extruder or other. Means for feeding the belt material is generally designated 12, which may be suitable roller means, say driven by a motor 13, or other suitable belt feeding means. A belting cut-off or severance station is designated 15, at one end of an apron 16, and spaced a predetermined distance from a belt stop member or arm 17 at the other end of the apron.

Opposite to the belting material supply 10, spaced rightward beyond the apron 16 as seen in FIG. 1, is a supply of buckle material 20, say a coil or strip of aluminum or steel, which may be mounted on a suitable supply spindle 21. From stock reel 20 there passes the buckle stock or strip material 22, as through a web or strip feeder 23. From the feeder 23, the buckle material 22 passes to a progressive forming station 24, such as a punching press, to form of the strip material a web of connected buckle formations 25. The leading endmost buckle formation in the web of connected buckle formations is fed to a crimping station 26, where the leading buckle formation is crimped about an end portion of a belt length 27 and severed from the next adjacent buckle formation.

By this crimping operation at crimping station 26, a buckle 30 is assembled with the cut length of a belt strip 27 to provide a completed belt 31. The belt 31 is located, immediately upon assembly, in the path of reciprocatory movement of a knock-off or ejection mechanism 32, which moves in the direction of arrows 33. Thus, the knock-off mechanism reciprocates to displace the completed belt 31 across the apron 16, onto a removal conveyor 35.

Figure 2:
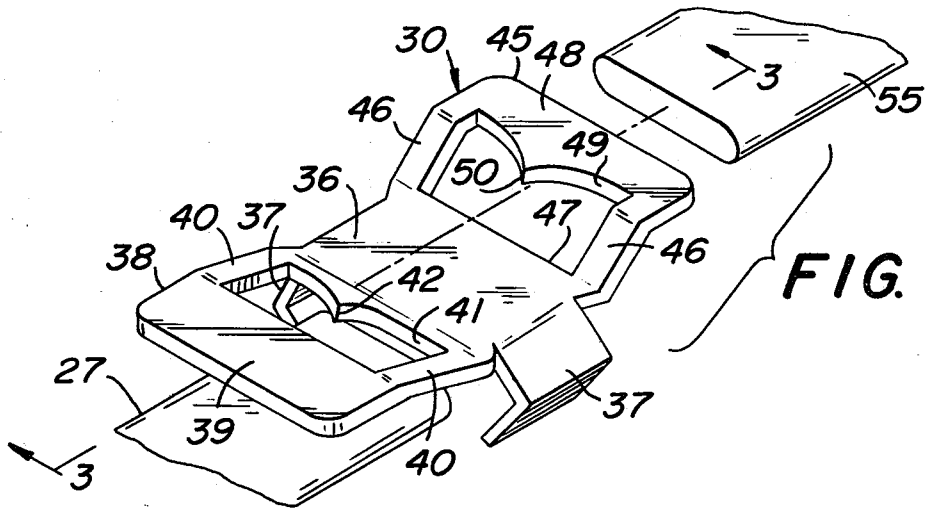
FIG. 2 is an exploded perspective view showing belt and buckle parts of the instant invention during assembly.

The buckle 30 shown in FIG. 2 is illustrated in a condition having been severed from the buckle formations 25, and prior to its being crimped about the belt strip 27. In this condition, it will be seen the buckle 30 is integrally fabricated of a single piece of sheet metal, and configured to include a laterally extending, longitudinally intermediate portion or panel 36. The intermediate portion or panel 36 may be generally rectangular and elongate in the transverse or lateral direction of the buckle, being provided at laterally opposite sides of the buckle with respective clinching elements or arms 37. The arms 37 are shown in FIG. 2 as extending generally outwardly and downwardly from the plane of intermediate panel 36 beyond the adjacent nether portion of belt strip 27. An inturned gripping end portion **37*a* extends from each arm 37. Laterally coextensive with the intermediate panel 36, and extending integrally therefrom is a generally U-shaped longitudinally inner portion 38, including a transverse bar 39 parallel to and spaced from the panel 36, and a pair of legs 40 extending from opposite ends of the bar in general parallelism with each other and terminating at the laterally extending edge 41 of panel 36, integral therewith. Thus, the U-shaped portion 38 defines a loop with the inner edge of panel 36**, for a purpose appearing presently.

Figure 3:
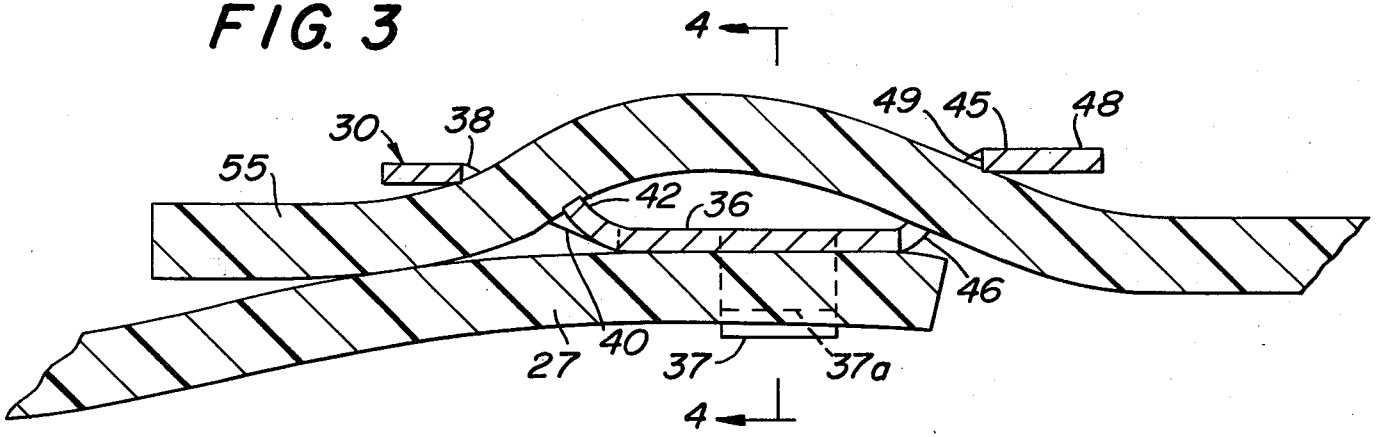
FIG. 3 is a longitudinal sectional view through the assembled parts of FIG. 2.

As appears in FIGS. 2 and 3, the legs 40 may incline obliquely from the panel 36 away from the belt strip 27 to the bar 39, and the latter may be generally parallel to and offset from the panel 36. Also, the panel edge 41 may be provided laterally medially thereof with a point or barb 42 projecting into the opening of loop 38, toward and terminating short of the bar 39.

On its longitudinally outward side and coextensive therewith, the intermediate panel 36 is provided with another loop-defining generally U-shaped formation 45. The formation 45 may include a pair of laterally spaced legs 46 extending in parallelism with each other from opposite ends of the outer edge 47 of panel 36, and terminating in a laterally extending member or bar 48. Thus, the bar 48 is spaced longitudinally of the buckle from the panel 36, and combines with the latter and legs 46 to define a loop 45. The legs 46 may extend obliquely from the panel 36, outwardly away from the belt strip 27, while the bar 48 may be generally parallel to and outwardly offset from the plane of panel 36. The inner edge 49 of bar 48 may be provided laterally medially thereof with one or more barbs or points 50 entering into the opening of loop 45.

Figure 4:
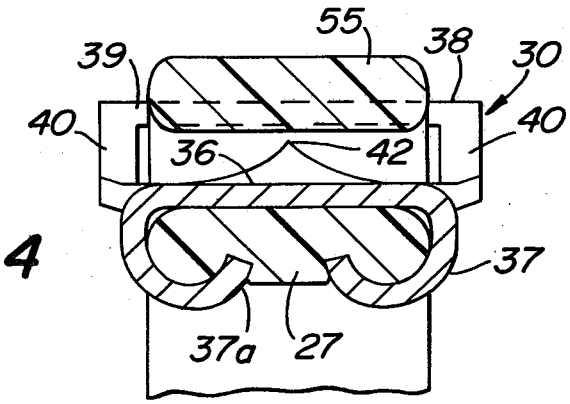
FIG. 4 is a transverse sectional view taken generally along the line 4—4 of FIG. 3.

In the condition of FIGS. 3 and 4, the buckle 30 is fully assembled with the belt strip 27, which assembly requires only that the arms or clinching members 37 of FIG. 2 be swung or turned inwardly into an embracing, clinching relation with the belt strip 27, as at 37*a*. By this simple expedient, the buckle 30 is permanently assembled with and secured fast to the belt strip 127 to define a completed belt. Also shown in FIGS. 3 and 4 are the extension of the belt free end 55 inward successively through the openings of loops 45 and 38, where it will be apparent that the barbs 50 and 42 impale the belt strip to assure its retention in closed position against inadvertent removal.

Considering now in greater detail the assembly method of the present invention, wherein the strip stock 22 is fed progressively through the forming station 24 by the feeder 23. The forming station 24 may be a multi-station die which punches buckle openings in the strip material, and otherwise forms and trims the strip material to shape the buckle formations 25, which are substantially complete buckles except for being joined together by minute joining points or tags for simultaneous movement as a web or strip. The endmost buckle formation is fed to the crimping station 26 for final assembly with a belt strip.

From the other direction, the left hand side as shown in FIG. 1, the belt material 11 is fed through cut-off station 15 to crimping station 26 where it meets stop arm 17. The belt strip 27 with its portion at crimping station 26 is located such that the buckle 30 is disposed in facing engagement with adjacent end portion of the belt strip, and the clinching arms 37 extend beyond the belt strip.

Upon arrival of the belt strip 27 with its leading portion at the crimping station 26, suitable sensing means, which may be the arm 17 or other sensing means causes the belt strip to stop feeding and actuates the buckle crimping station to crimp the arms 37 about the belt strip. The strip cut-off station 15 may also be actuated to sever the desired length of strip 27. The knock-off or ejector station 32 is then actuated to displace the completed belt 31 to the removal conveyor 35.

Following the crimping of buckle 30 to belt strip 27 and ejection of belt 31, there is resumption of both the feeding operation by feeding means 12, and the progressive forming and feeding operation of metal forming station 24, to again locate the next buckle formation 25 in facing relation with the leading end portion of the next belt strip 27, for repetition of the above described assembly operation.

From the foregoing, it is seen that there is provided a highly advantageous belt construction and method of its manufacture wherein substantial economies are effected both in materials, by buckle construction and in labor and capital costs by the instant method, and which otherwise fully accomplishes its intended objects.

Although the present invention has been described in some detail by way of illustration and example for purposes of clarity of understanding, it is understood that certain changes and modifications may be made within the spirit of the invention.

What is claimed is:

1. A belt comprising an imperforate belt strip, a buckle at one end of said strip including an intermediate imperforate panel, and a pair of clinching arms extending from said panel laterally outwardly from opposite outer side edges of said panel and thence laterally inwardly in embracing engagement with and entering into said belt strip, the imperforate belt strip being firmly clamped by said arms in facing engagement with said imperforate panel.

2. A belt according to claim 1, said buckle comprising at least one open loop extending obliquely from one end of said panel generally longitudinally of said belt strip.

3. A belt according to claim 2, in combination with an additional open loop extending obliquely from the other end of said panel generally longitudinally of said belt strip.

* * * * *